United States Patent [19]

Ohtani et al.

[11] 4,283,704

[45] Aug. 11, 1981

[54] VARIABLE RESISTOR

[75] Inventors: Takeshi Ohtani; Susumu Nishimura; Kozo Magami; Katsuhisa Osada, all of Miyagi, Japan

[73] Assignee: Alps Electric Co., Ltd., Tokyo, Japan

[21] Appl. No.: 38,947

[22] Filed: May 14, 1979

[30] Foreign Application Priority Data

May 18, 1978 [JP] Japan ..... 53/66918[U]

[51] Int. Cl.[3] ..... H01C 10/22

[52] U.S. Cl. ..... 338/138; 338/89; 338/142; 338/162; 338/171; 338/174; 338/217; 338/320

[58] Field of Search ..... 338/89, 138, 128, 137, 338/139, 142, 217, 160, 162, 174, 320, 171, 202, 307–309; 29/610, 620

[56] References Cited

U.S. PATENT DOCUMENTS

| | | | |
|---|---|---|---|
| 2,101,441 | 12/1937 | Marsten | 338/171 |
| 2,134,870 | 11/1938 | Fruth | 338/142 |
| 3,965,454 | 6/1976 | Puerner | 338/171 X |
| 4,123,741 | 10/1978 | Kiyono et al. | 338/128 X |

FOREIGN PATENT DOCUMENTS

| | | | |
|---|---|---|---|
| 1516929 | 2/1968 | France | 338/138 |
| 377315 | 7/1932 | United Kingdom | 338/142 |
| 479046 | 1/1938 | United Kingdom | 338/138 |

*Primary Examiner*—C. L. Albritton

*Attorney, Agent, or Firm*—Guy W. Shoup; Gerard F. Dunne

[57] ABSTRACT

In a variable resistor of the type wherein there is formed on an insulating substrate a resistive member having wide portions and narrow portions in the sliding direction of a slide member and ends thereof wired respectively to a ground terminal and an input terminal. A plurality of contact elements formed on said slide member are brought into sliding contact with said resistive member and a high resistance film allowing the passage of electrostatic charges therethrough is formed at portions of said insulating substrate lying within the sliding passage of said contact elements so that a part of said contact elements comes into contact therewith when it comes off from said resistive member.

2 Claims, 3 Drawing Figures

VARIABLE RESISTOR

BACKGROUND OF THE INVENTION

This invention relates to variable resistors and more specifically to an improved construction of the pattern of the resistive member of such resistors so as to prevent occurrence of electrostatic noise.

In order to improve the accuracy of their output resistance, conventional variable resistors often have a construction as exemplified in FIG. 1. Namely, terminal sections 6 and 8, each consisting of a highly conductive film, are formed on an insulating substrate 1 to connect with a ground terminal and an input terminal, respectively, and a resistive member is formed by a plurality of resistive elements 3, 4 and 5, each having a specific resistance different from that of the others and a generally hemi-crescent shape in which the width becomes progressively narrower from one end to the other. The resistive elements 3, 4 and 5 are connected subsequentially between the abovementioned terminal sections 6 and 8, thus forming a resistive member 2. Typically, the resistive elements are formed by printing carbon paste or the like on the substrate A. The variable resistors of this type further include a slide member 9 having a plurality of contact elements 10 that are brought into sliding contact with the resistive member 2 and are connected to a terminal section 7 communicating with an output terminal.

In the variable resistors of the above-described type, when the contact elements 10 are located at the position of the narrow width of the resistive member 2 as illustrated in FIG. 1, the outer contact elements come off the resistive member 2 and come into direct contact with the surface of the insulating substrate 1 at a location adjacent the resistive element 2. If the slide member 9 is further rotated under this state, static electricity tends to build upon the substrate 1 due to sliding friction between the outer contact elements 10 and the insulating substrate 1 and to other factors and this results eventually in electrostatic noise during operation of the resistor.

BRIEF DESCRIPTIONS OF THE DRAWINGS

DESCRIPTION OF THE PREFERRED EMBODIMENT

Figure 1:
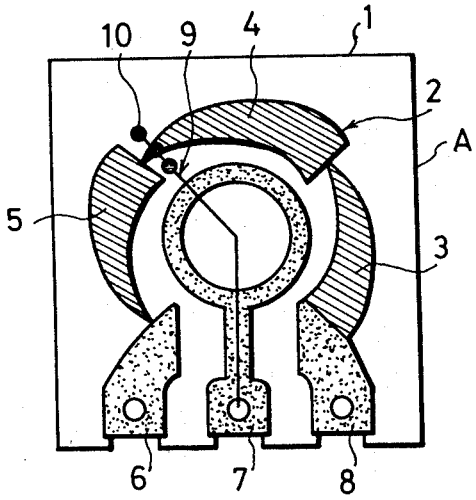
Fig. 1 PRIOR ART
FIG. 1 is a plan view of a conventional variable resistor.
Figure 2:
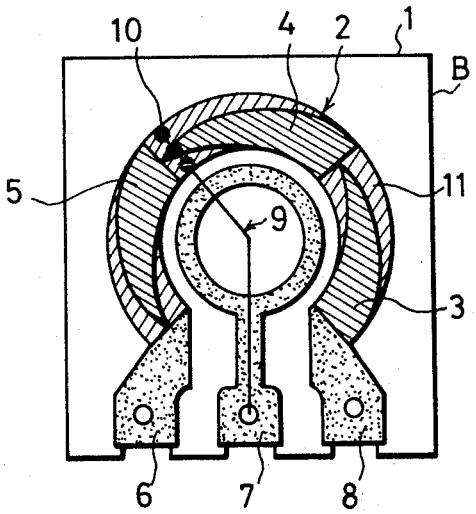
FIG. 2 is a plan view of a variable resistor in accordance with the present invention.

The present invention is directed to solve the abovementioned drawbacks of conventional variable resistors. A preferred embodiment of the invention will now be explained by referring to FIGS. 2 and 3 wherein like reference numerals are used to identify like constituent elements as in FIG. 1. Reference numeral 11 represents a high resistance film that is formed in an arc shape between the terminal sections 6 and 8 on the insulating substrate 1 and is useful for preventing occurrence of static electricity. The film has a surface resistance of $1\times10^7$ to $1\times10^9$ Ohms. The resistive member 2 consisting of the resistive elements 3, 4 and 5 is formed on this high resistance film 11.

The width of the high resistance film 11 is substantially equal to that of the widest portion of the resistive member 2. The high resistance film 11 is formed by printing a material such as carbon paste, for example, in a portion so that the resistance between the surface resistance of the high resistance film 11 is at least 100 times greater than the resistance across the ends of the resistive member 2. This ratio may be suitably changed in accordance with the resistance of the resistive member 2. Thus, the high resistance film 11 either neutralizes immediately static electricity formed as described above or provides a path for its escape so that no influence is exerted on the output resistance characteristics of the resistor. (For, the surface resistance of the high resistance film 11 is not higher than $1\times10^7$–$1\times10^9$ Ohms and readily neutralizes the static electricity.)

Incidentally, in this embodiment, the surface resistance of the high resistance film 11 (resistance between both opposing edges of the film per 1 $cm^2$) is set to be 100 MΩ while the resistance across both ends of the resistive member 2 is set to 10 KΩ.

Figure 3:
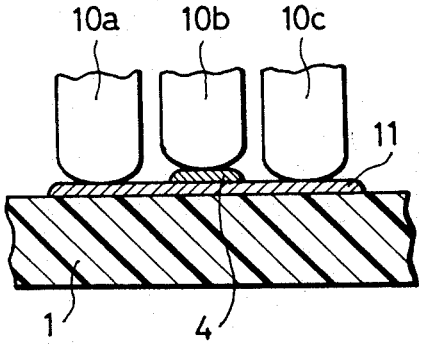
FIG. 3 is a sectional view useful for explaining the action of the resistor shown in FIG. 2.

In the variable resistor of the embodiment having the abovementioned construction, when the slide member 9 is rotated and the contact elements 10 (assuming that it consists of three elements 10*a*, 10*b* and 10*c*) are located at the position of the narrow width of the resistive member 2 as shown in FIG. 3, the contact element 10 comes into sliding contact with the resistive member 2 (resistive element 4) while the contact elements 10*a* and 10*c* come off from the resistive member 2 and come into sliding contact with a portion of the high resistance film 11. Accordingly, even when the static electricity occurs due to the sliding friction of the contact elements 10*a*, 10*b* with the high resistance film 11, the film 11 either neutralizes immediately the static electricity or escapes it to the ground terminal through the film 11 and the terminal section 8 so that no electrostatic noise is allowed to occur. Further, since the resistance of the high resistance film 11 is by far higher than that of the resistive member 2, no such influence is given that changes the resistance change curve to any practical extent.

As described above, the variable resistor in accordance with the present invention provides the effect of preventing the occurrence of the electrostatic noise on the resistor substrate.

Though the abovementioned embodiment illustrates a rotary type variable resistor, the principle of the present invention can of course be applied as such to a linear type variable resistor and the present invention includes such an embodiment within the scope thereof.

What is claimed is:

1. A variable resistor having an insulating substrate; a resistive member carried on said insulating substrate and having a width varying in the longitudinal direction thereof; a first terminal section formed on said insulating substrate and connected to an output terminal; a second terminal section connected to one end portion of said resistive member; a third terminal section connected to the other end portion of said resistive member; a slide member connected to said first terminal section and having a plurality of contact elements sliding on said resistive member; and a high resistance film formed on said insulating substrate, said high resistance film underlying said resistive member and having a surface resistance of about $1\times10^7$ to $1\times10^9$ ohms per square centimeter so as to come into contact with a part of said contact elements at the portion of a narrow width of said resistance member and neutralize the adverse effects of any static electricity generated by the movement of said contact elements.

2. A variable resistor as defined in claim 1 wherein the surface resistance of said high resistance film is at least 100 times the resistance across the ends of said resistive member.

* * * * *